US007182698B2

(12) United States Patent
Tseng

(10) Patent No.: US 7,182,698 B2
(45) Date of Patent: Feb. 27, 2007

(54) SHOCK-ABSORBING GOLF CLUB HEAD

(75) Inventor: Wen-Cheng Tseng, 14F, No. 66, Kuanghua 2 Rd., Chienchen Dist., Kaohsiung (TW)

(73) Assignees: Wen-Cheng Tseng (TW); Kung-Wen Lee (TW); Super Way Technology Co., Ltd. (TW)

( * ) Notice: Subject to any disclaimer, the term of this patent is extended or adjusted under 35 U.S.C. 154(b) by 215 days.

(21) Appl. No.: 11/046,802

(22) Filed: Feb. 1, 2005

(65) Prior Publication Data

US 2005/0209023 A1 Sep. 22, 2005

(30) Foreign Application Priority Data

Mar. 16, 2004 (TW) ..... 93107017 A

(51) Int. Cl.
*A63B 53/04* (2006.01)

(52) U.S. Cl. ..... 473/332; 473/342; 473/345; 473/349

(58) Field of Classification Search ..... 473/332, 473/342, 334–339, 349, 326, 345
See application file for complete search history.

(56) References Cited

U.S. PATENT DOCUMENTS

| | | | | |
|---|---|---|---|---|
| 4,928,972 | A * | 5/1990 | Nakanishi et al. | 473/332 |
| 5,078,397 | A * | 1/1992 | Aizawa | 473/342 |
| 5,303,922 | A * | 4/1994 | Lo | 473/330 |
| 5,346,213 | A * | 9/1994 | Yamada | 473/329 |
| 5,447,311 | A * | 9/1995 | Viollaz et al. | 473/342 |
| 5,492,327 | A * | 2/1996 | Biafore, Jr. | 473/332 |
| 5,524,331 | A * | 6/1996 | Pond | 29/527.4 |
| 5,713,800 | A * | 2/1998 | Su | 473/342 |
| 5,766,092 | A * | 6/1998 | Mimeur et al. | 473/329 |
| 5,772,527 | A * | 6/1998 | Liu | 473/324 |
| 5,899,821 | A * | 5/1999 | Hsu et al. | 473/332 |
| 6,042,486 | A * | 3/2000 | Gallagher | 473/329 |
| 6,443,857 | B1 * | 9/2002 | Chuang | 473/332 |
| 6,743,117 | B2 * | 6/2004 | Gilbert | 473/332 |
| 6,921,343 | B2 * | 7/2005 | Solheim | 473/329 |
| 6,932,717 | B2 * | 8/2005 | Hou et al. | 473/332 |
| 7,070,513 | B2 * | 7/2006 | Takeda et al. | 473/329 |
| 2002/0094883 | A1 * | 7/2002 | Chuang | 473/332 |
| 2004/0053704 | A1 * | 3/2004 | Gilbert | 473/290 |
| 2005/0096150 | A1 * | 5/2005 | Hou et al. | 473/332 |
| 2005/0107183 | A1 * | 5/2005 | Takeda et al. | 473/326 |
| 2005/0143188 | A1 * | 6/2005 | Tseng | 473/332 |
| 2005/0245325 | A1 * | 11/2005 | Gilbert et al. | 473/325 |

* cited by examiner

*Primary Examiner*—Sebastiano Passaniti
(74) *Attorney, Agent, or Firm*—Fei-Fei Chao; Andrews Kurth LLP

(57) ABSTRACT

A shock-absorbing golf club head has a head body, a faceplate and a shock-absorbing core. The head body has a crown, a sole, a toe, a shank, a rear, an open front, a core cavity and an air outlet. The open front has an inner shoulder. The core cavity is defined in the head body and communicates with the open front. The air outlet is defined through the head body, and communicates with the core cavity. The faceplate is mounted securely on the inner shoulder of the open front of the head body. The shock-absorbing core is mounted in the core cavity. The air in the core cavity is discharged to the ambient atmosphere through the air outlet when a foaming agent serving as the shock-absorbing core foams inside the core cavity.

7 Claims, 11 Drawing Sheets

SHOCK-ABSORBING GOLF CLUB HEAD

BACKGROUND OF THE INVENTION

1. Field of the Invention

The present invention relates to a golf club head, and more particularly to a shock-absorbing golf club head that has an air outlet to allow air inside the core cavity to escape from the shock-absorbing golf club head when resilient foam forms a core inside the core cavity.

2. Description of Related Art

Shock-absorbing golf club heads usually have a hollow cavity to allow a shock-absorbing core to be mounted in the shock-absorbing golf club head.

A conventional shock-absorbing golf club head comprises a core cavity, a shock-absorbing core and a faceplate. The core cavity is defined in the shock-absorbing golf club head and has a volume. The shock-absorbing core is made of resilient foam, is mounted in the core cavity and has a volume larger than the core cavity. The faceplate is mounted on the shock-absorbing golf club head, presses and forces the shock-absorbing core to tightly fit into the core cavity and seals the core cavity.

However, the shock-absorbing core is compressed by the faceplate to a volume smaller than the shock-absorbing core without any external force. Therefore, the shock-absorbing effect of the shock-absorbing core is impaired.

Another conventional shock-absorbing golf head comprises a core cavity, a core port, a faceplate and a shock-absorbing core. The core cavity is defined in the shock-absorbing golf club head. The core port is defined through the shock-absorbing golf head and communicates with the core cavity. The faceplate is mounted on the shock-absorbing golf club head and closes the core cavity except for the core port. The shock-absorbing core is formed in the core cavity and abuts the faceplate. To the shock-absorbing core in the golf club head, liquid resilient foam is injected through the core port and foams to fill the core cavity.

However, the air inside the core cavity mixes with the injected resilient foam so the resilient foam has an irregular consistency and parts of the resilient foam have different densities.

To overcome the shortcomings, the present invention provides a shock-absorbing golf club head to mitigate or obviate the aforementioned problems.

SUMMARY OF THE INVENTION

The main objective of the invention is to provide a shock-absorbing golf club head that has an air outlet to allow air inside the core cavity to escape from the shock-absorbing golf club head when a foaming agent serving as a shock-absorbing core foams inside the core cavity.

A shock-absorbing golf club head in accordance with the present invention comprises a head body, a faceplate and a shock-absorbing core.

The head body has a crown, a sole, a toe, a shank, a rear, an open front, a core cavity and an air outlet. The open front has an inner shoulder. The core cavity is defined in the head body and communicates with the open front. The air outlet is defined through the head body, and communicates with the core cavity. The faceplate is mounted securely on the inner shoulder of the open front of the head body. The shock-absorbing core is formed in the core cavity.

Other objectives, advantages and novel features of the invention will become more apparent from the following detailed description when taken in conjunction with the accompanying drawings.

DETAILED DESCRIPTION OF PREFERRED EMBODIMENT

A shock-absorbing golf club head in accordance with the present invention comprises a head body, a faceplate and a shock-absorbing core.

The head body has a crown, a sole, a toe, a shank, a rear, an open front, a core cavity and an air outlet. The open front has an inner shoulder. The core cavity is defined in the head body and communicates with the open front. The air outlet is defined through the head body and communicates with the core cavity. The faceplate is mounted securely on the inner shoulder of the open front of the head body. The shock-absorbing core is mounted in the core cavity.

Figure 1:
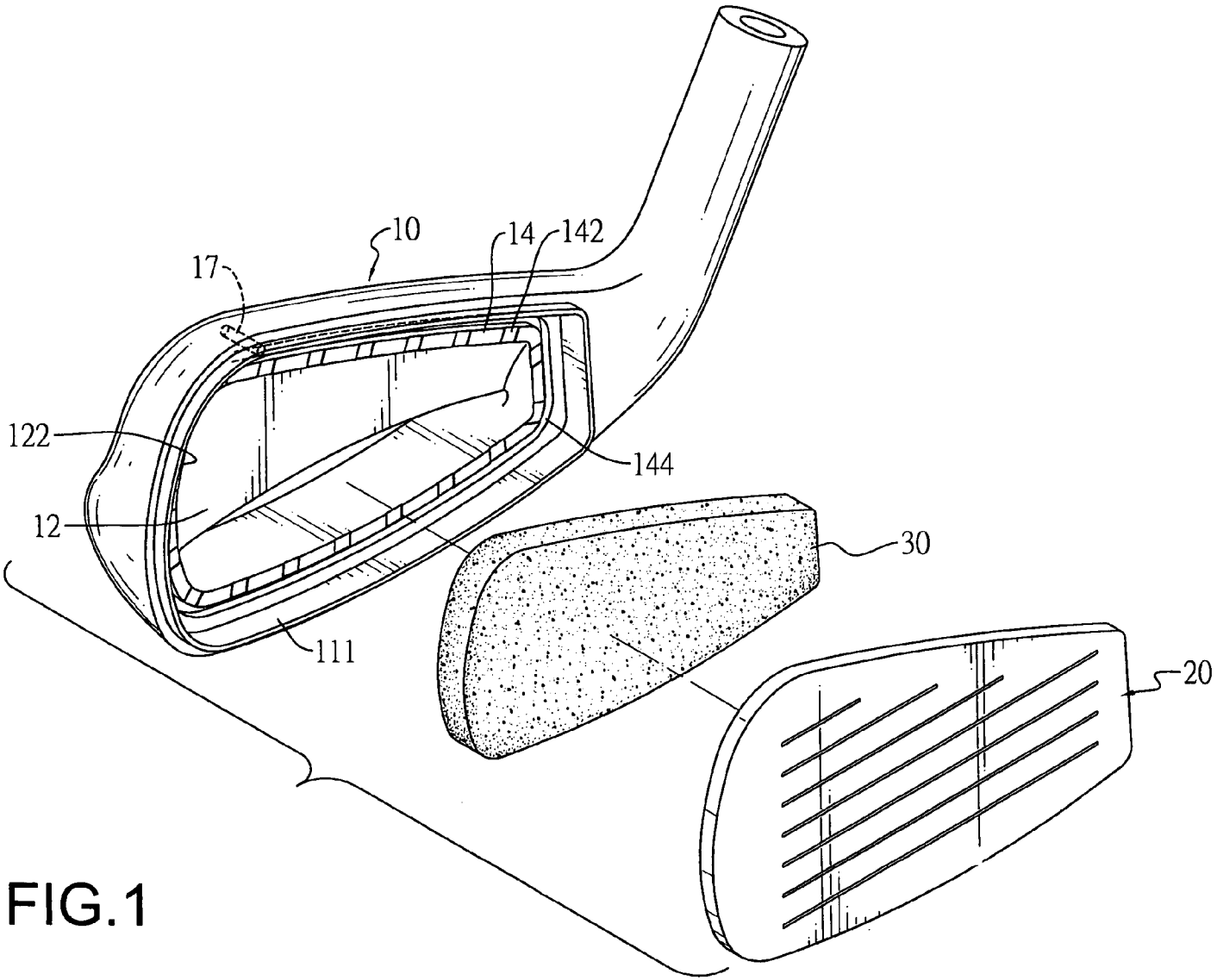
FIG. 1 is an exploded perspective view of a first embodiment of a shock-absorbing golf club head in accordance with the present invention.
Figure 2:
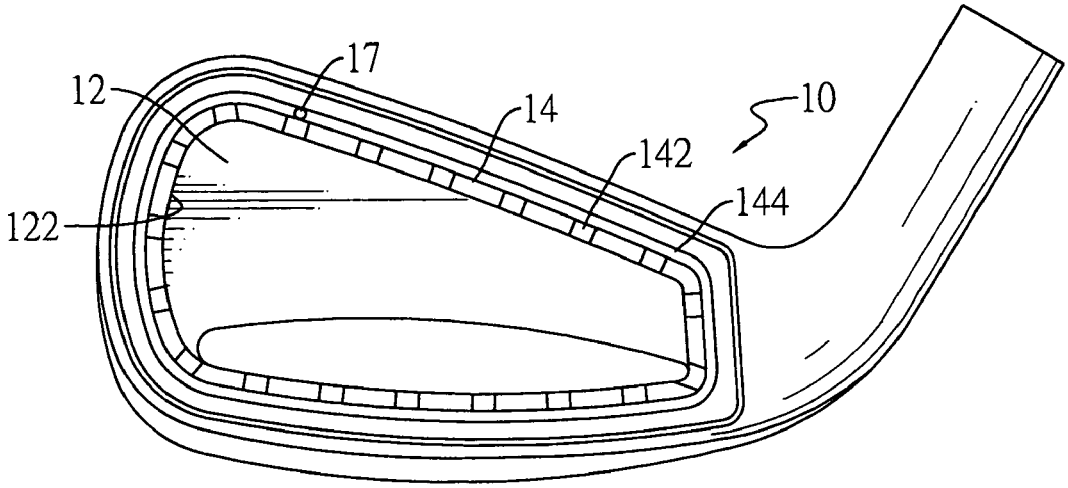
FIG. 2 is a front view of the shock-absorbing golf club head in FIG. 1.
Figure 3:
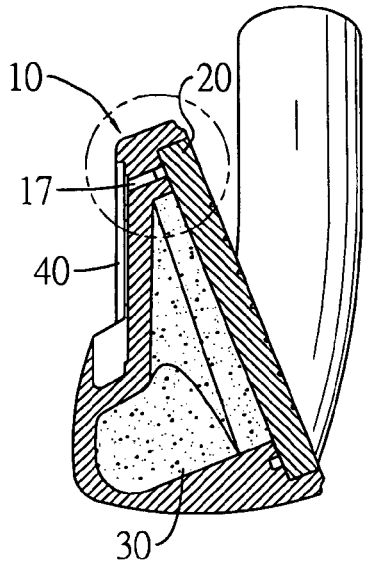
FIG. 3 is a cross sectional end view of the shock-absorbing golf club head in FIG. 1.
Figure 4:
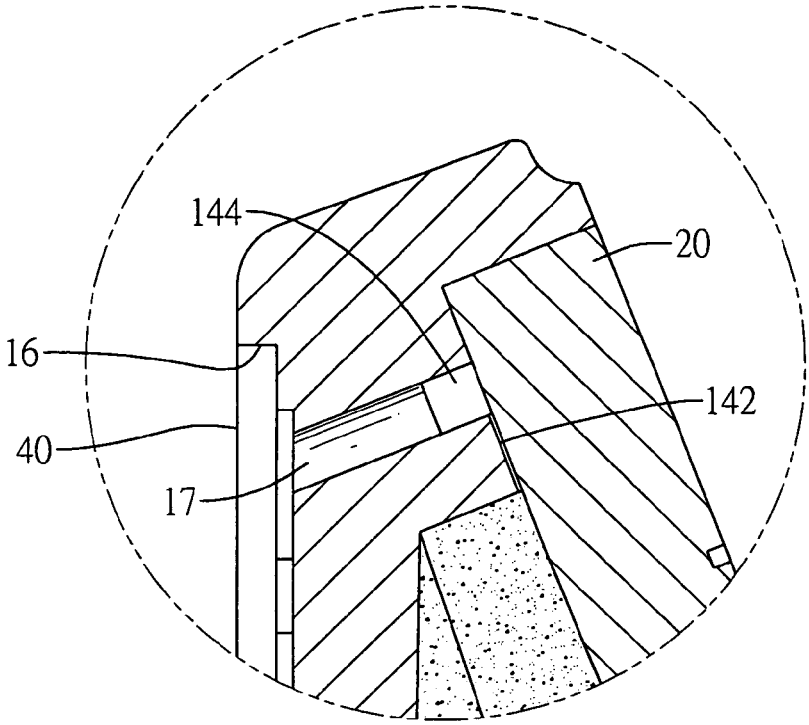
FIG. 4 is an enlarged cross sectional end view of the shock-absorbing golf club head in FIG. 1.

With reference to FIGS. 1 to 4, a first embodiment of the shock-absorbing golf club head in accordance with the present invention comprises a head body (10), a faceplate (20), a shock-absorbing core (30) and an optional rear panel (40).

The head body (10) has a crown, a sole, a toe, a shank, a rear, an open front, a core cavity (12), an inner front annular surface (14), an air outlet (17) and an optional rear recess (16).

The open front has an inner shoulder (111).

The core cavity (12) is defined in the head body (10), communicates with the open front and has an inner surface (122).

The inner front annular surface (14) is defined between the inner shoulder (111) and the core cavity (12) and has multiple notches (142) and an annular groove (144). The notches (142) are defined radially in the inner front annular surface (14) and communicate respectively with the core cavity (12). The annular groove (144) is defined in the inner front annular surface (14) around the core cavity (12) and communicates with the notches (142). The air outlet (17) is defined through the rear of the head body (10) and communicates with the annular groove (144) to communicate indirectly with the core cavity (12). The optional rear recess (16) is defined in the rear of the head body (10) and communicates with the air outlet (17).

The faceplate (20) has an outer edge, is mounted securely on the inner shoulder (111) of the open front of the head body (10) and abuts the inner front annular surface (14). The faceplate (20) is mounted securely on the inner shoulder (111) by welding the outer edge of the faceplate (20) to the inner shoulder (111).

The shock-absorbing core (30) is a thermoplastic elastomer and is mounted in the core cavity. To mount the shock-absorbing core (30) in the head body (10), an appropriate quantity of thermoplastic elastomer is put into the core cavity (12) before the faceplate (20) attached to the head body (10). Then the head body (10), faceplate (20) and the thermoplastic elastomer are heated to a temperature 170° to 180° C. At this temperature, the thermoplastic elastomer foams, fills the core cavity (12) and tightly abuts the faceplate (20). Simultaneously, the air in the core cavity (12) is discharged out of the head body (10) to the ambient atmosphere through the notches (142), the annular groove (144) and the air outlet (17).

The optional rear panel (40) is mounted in the rear recess (16) and seals the air outlet (17) after the shock-absorbing core (30) foams. The optional panel (40) may have patterns or characters for decoration.

Figure 8:
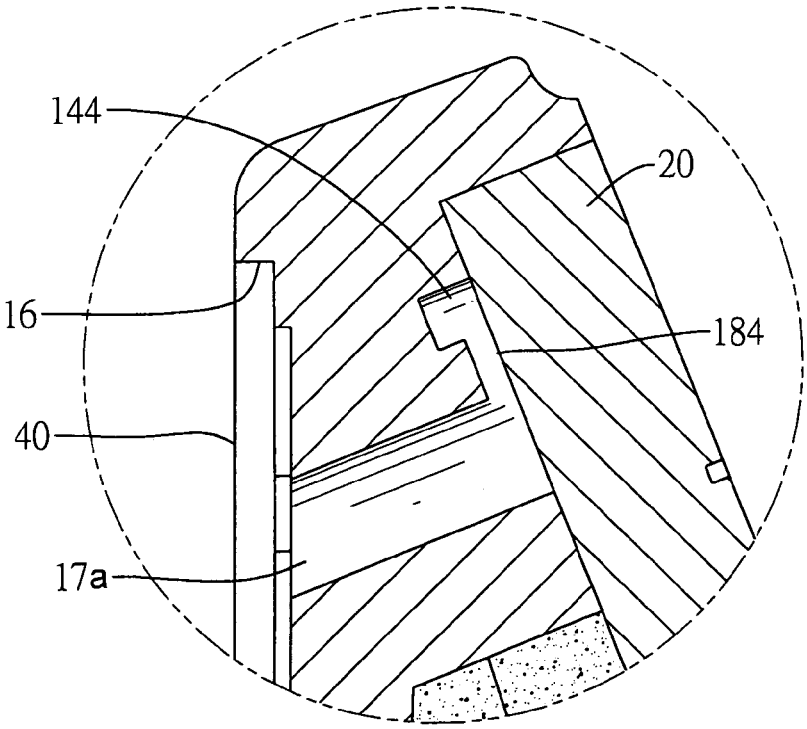
FIG. 8 is an enlarged view of the shock-absorbing golf club head in FIG. 5.
Figure 5:
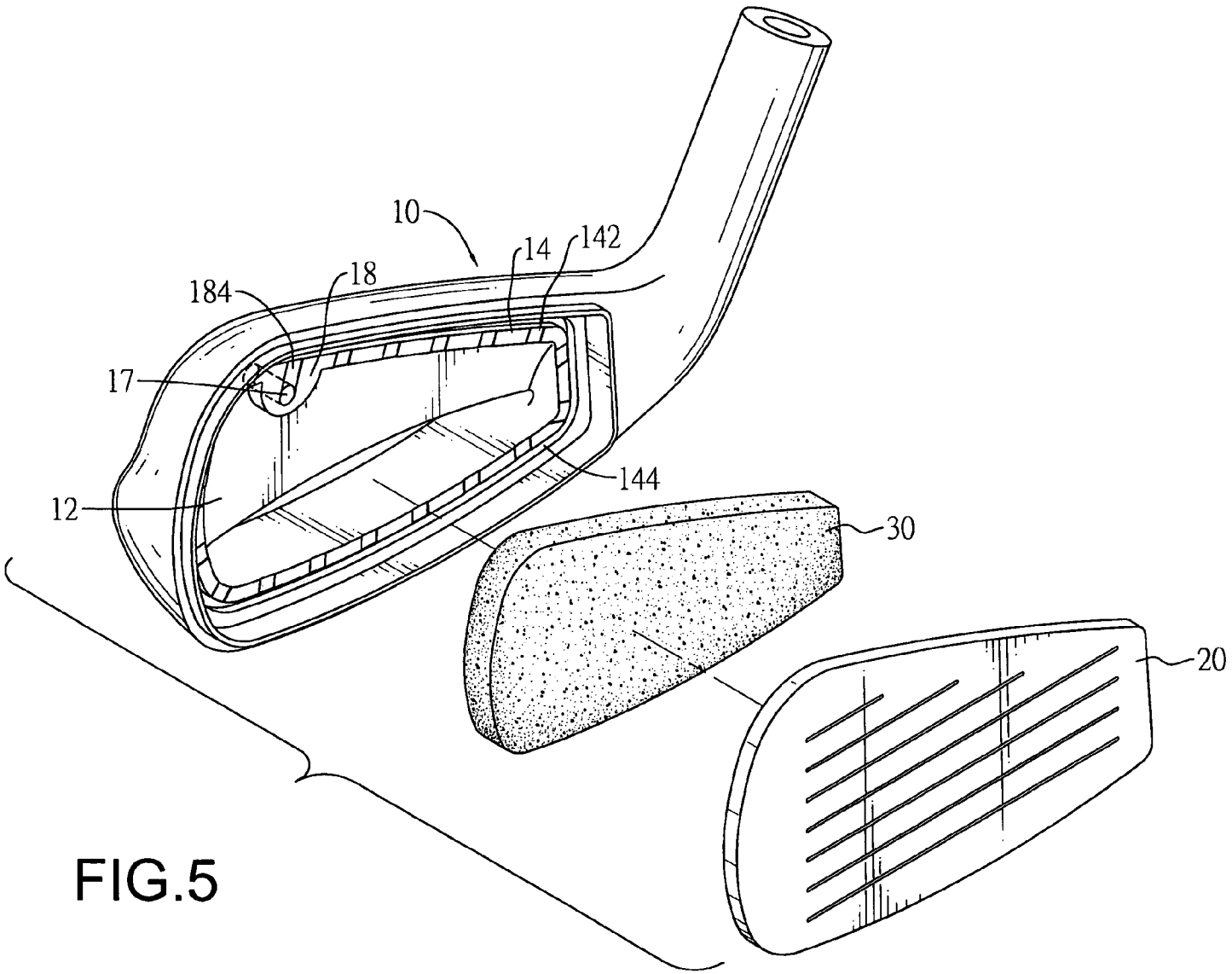
FIG. 5 is an exploded perspective view of a second embodiment of a shock-absorbing golf club head in accordance with the present invention.
Figure 6:
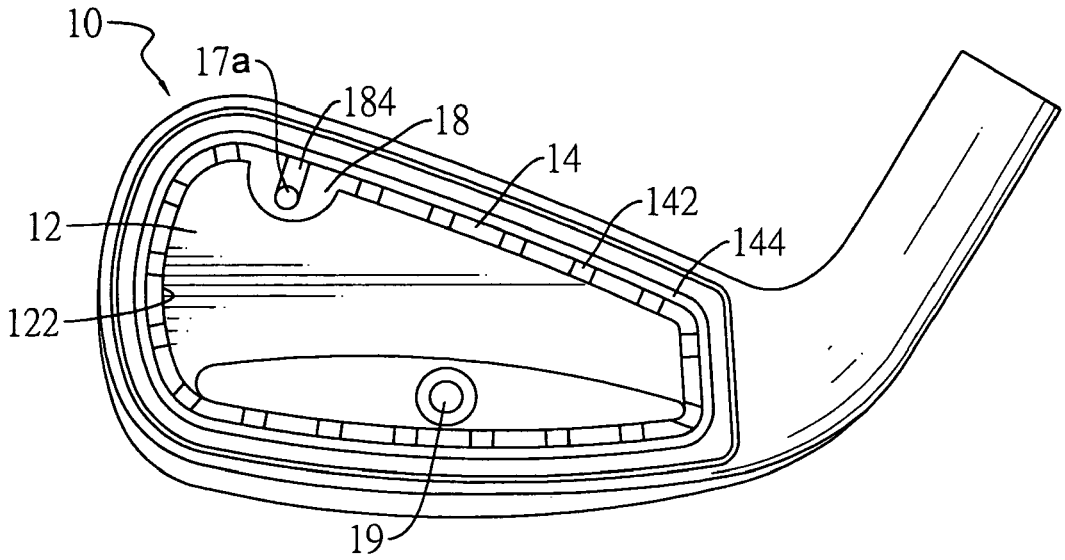
FIG. 6 is a front view of the shock-absorbing golf club head in FIG. 5.
Figure 7:
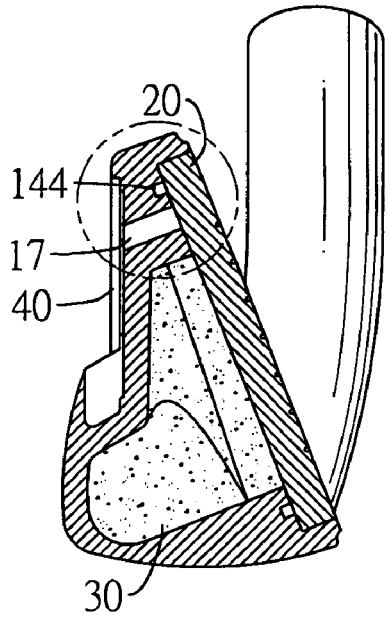
FIG. 7 is a cross sectional end view of the shock-absorbing golf club head in FIG. 5.

With reference to FIGS. 5 to 8, a second embodiment of the shock-absorbing golf club head in accordance with the present invention is a modification of the first embodiment and further has a protrusion (18). The protrusion (18) is formed on the inner surface (122) of the core cavity (12) flush with the inner front annular surface (14) and has a guide recess (184). The guide recess (184) communicates with the annular groove (144). The air outlet (17*a*) extends through the protrusion (18) and communicates with the guide recess (184).

When the thermoplastic elastomer foams in the core cavity (12), the air in the core cavity (12) is discharged out of the head body (10) to the ambient atmosphere through the notches (142), the annular groove (144), the guide recess (184) and the air outlet (17).

Figure 10:
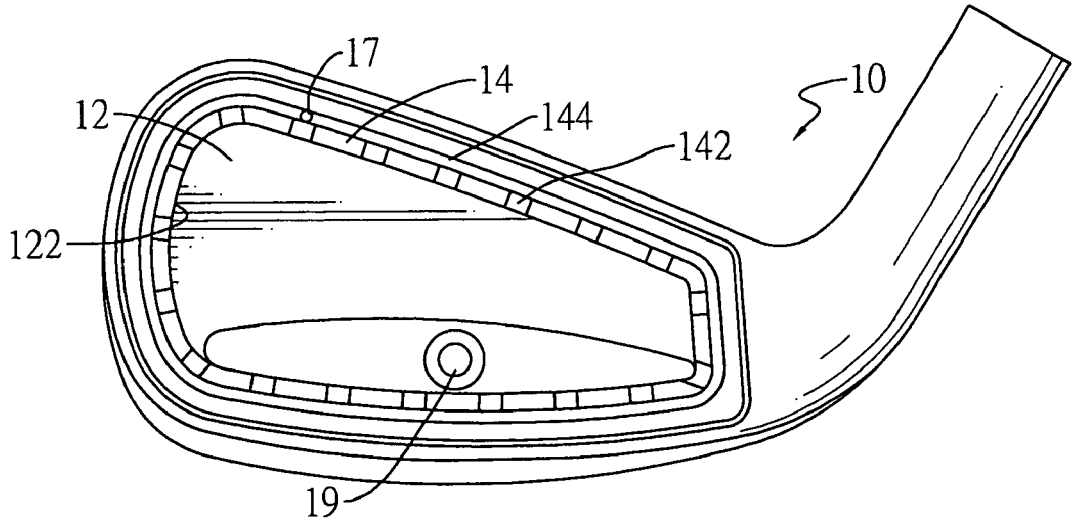
FIG. 10 is a front view of the shock-absorbing golf club head in FIG. 9.
Figure 11:
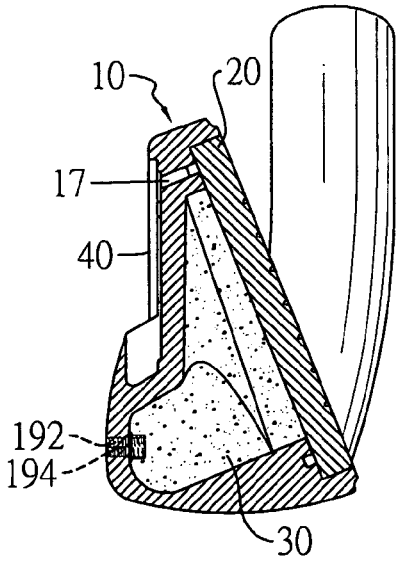
FIG. 11 is a cross sectional end view of the shock-absorbing golf club head in FIG. 9.
Figure 9:
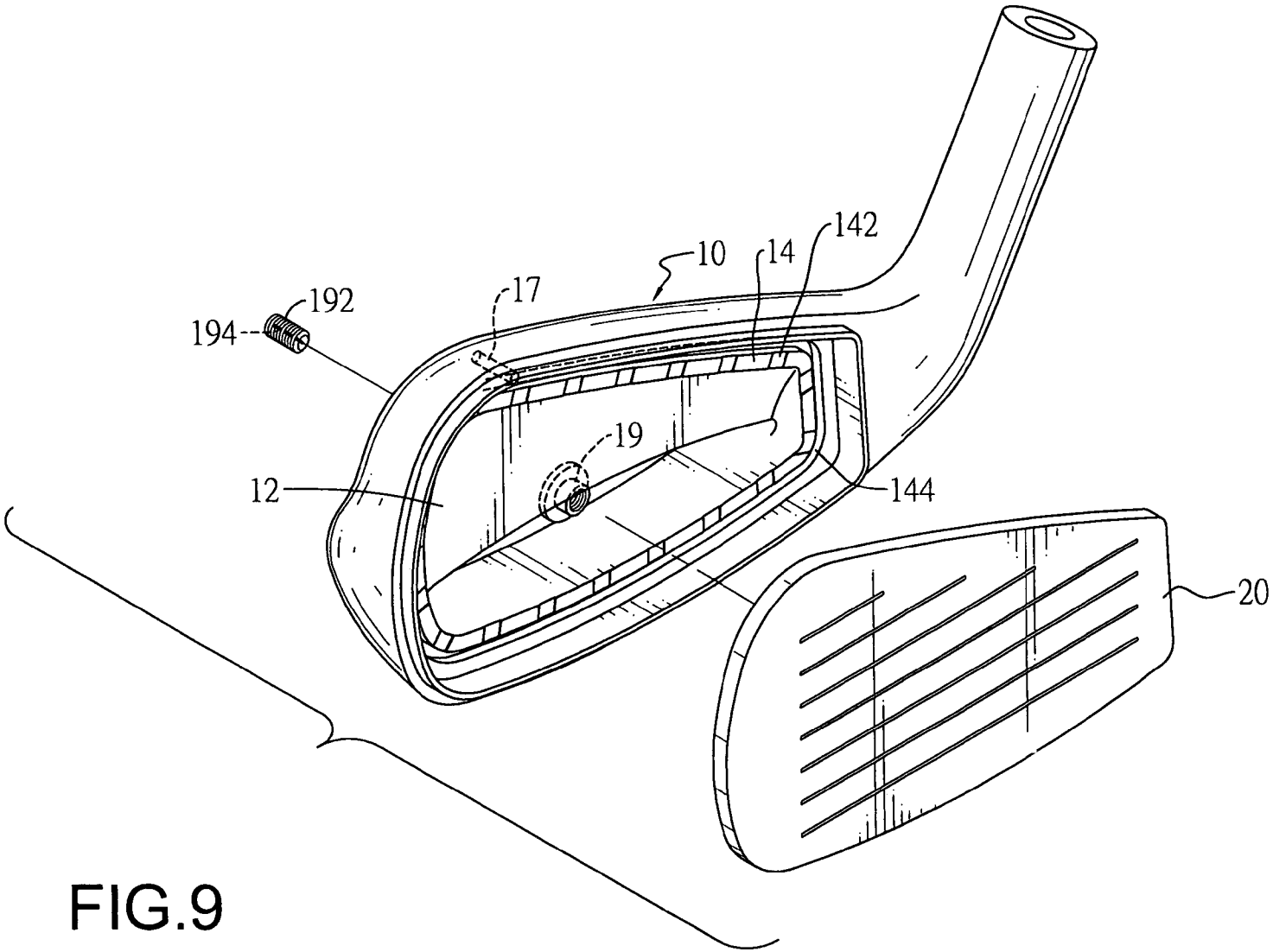
FIG. 9 is an exploded perspective view of a third embodiment of a shock-absorbing golf club head in accordance with the present invention.
Figure 16:
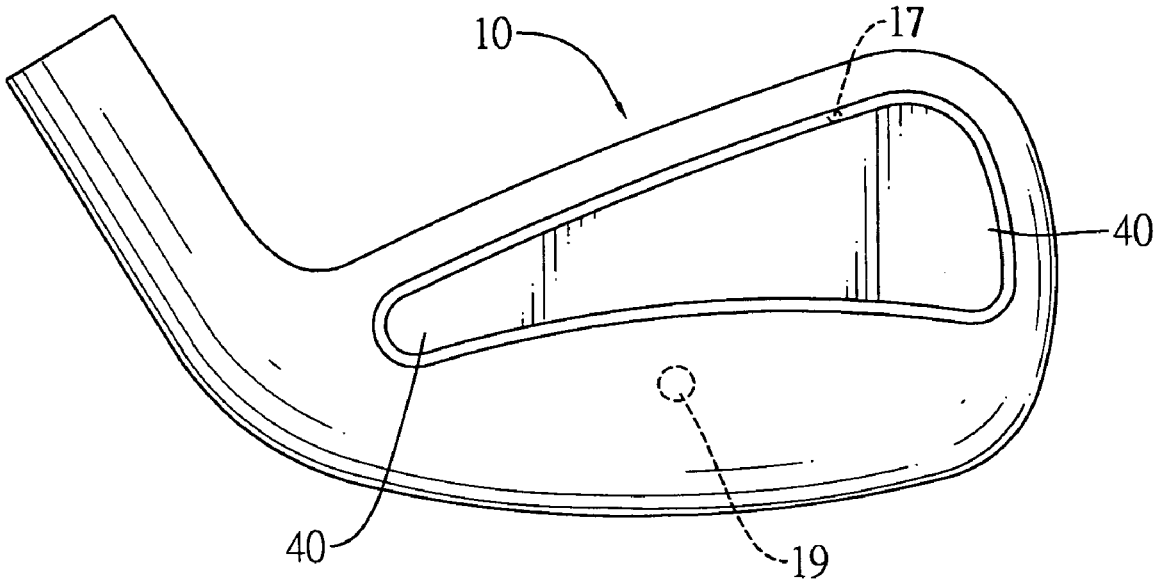
FIG. 16 is a rear view of the shock-absorbing golf club head in FIG. 9.

With reference to FIGS. 9 to 11 and 16, a third embodiment of the shock-absorbing golf club head in accordance with the present invention is the same as the first embodiment and further comprises a core port (19), a plug (192) and a transparent plug.

The core port (19) is defined through the rear of the head body (10), communicates with the core cavity (12) and has an inner thread. The plug (192) is mounted detachably in the core port (19) and has an outer thread and an optional ventilation hole (194). The outer thread of the plug (192) corresponds to the inner thread of the core port (19), and the plug (192) screws into the core port (19). The plug is removed to put powdered, liquid or granular thermoplastic elastomer into the core cavity (12). The optional ventilation hole (194) is defined axially through the plug (192) and communicates with the core port (19) to allow air to escape during the thermoplastic elastomer foaming process. After the foaming process is complete, the plug (192) is removed and replaced with a transparent plug.

Figure 13:
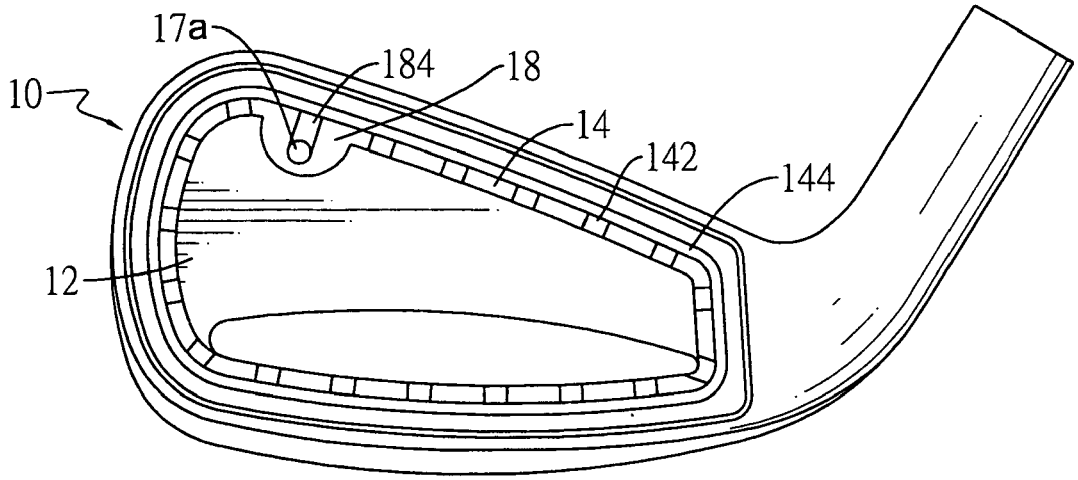
FIG. 13 is a front view of the shock-absorbing golf club head in FIG. 12.
Figure 14:
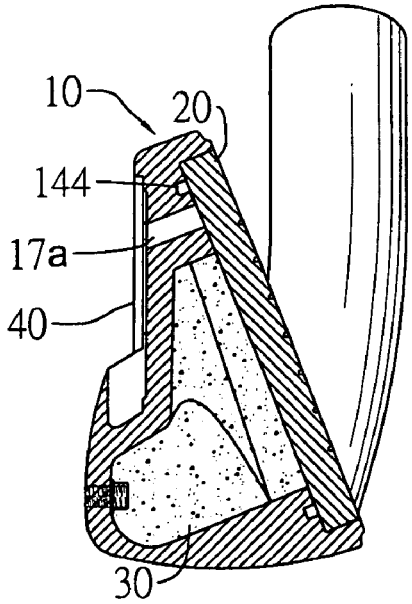
FIG. 14 is a cross sectional end view of the shock-absorbing golf club head in FIG. 12.
Figure 12:
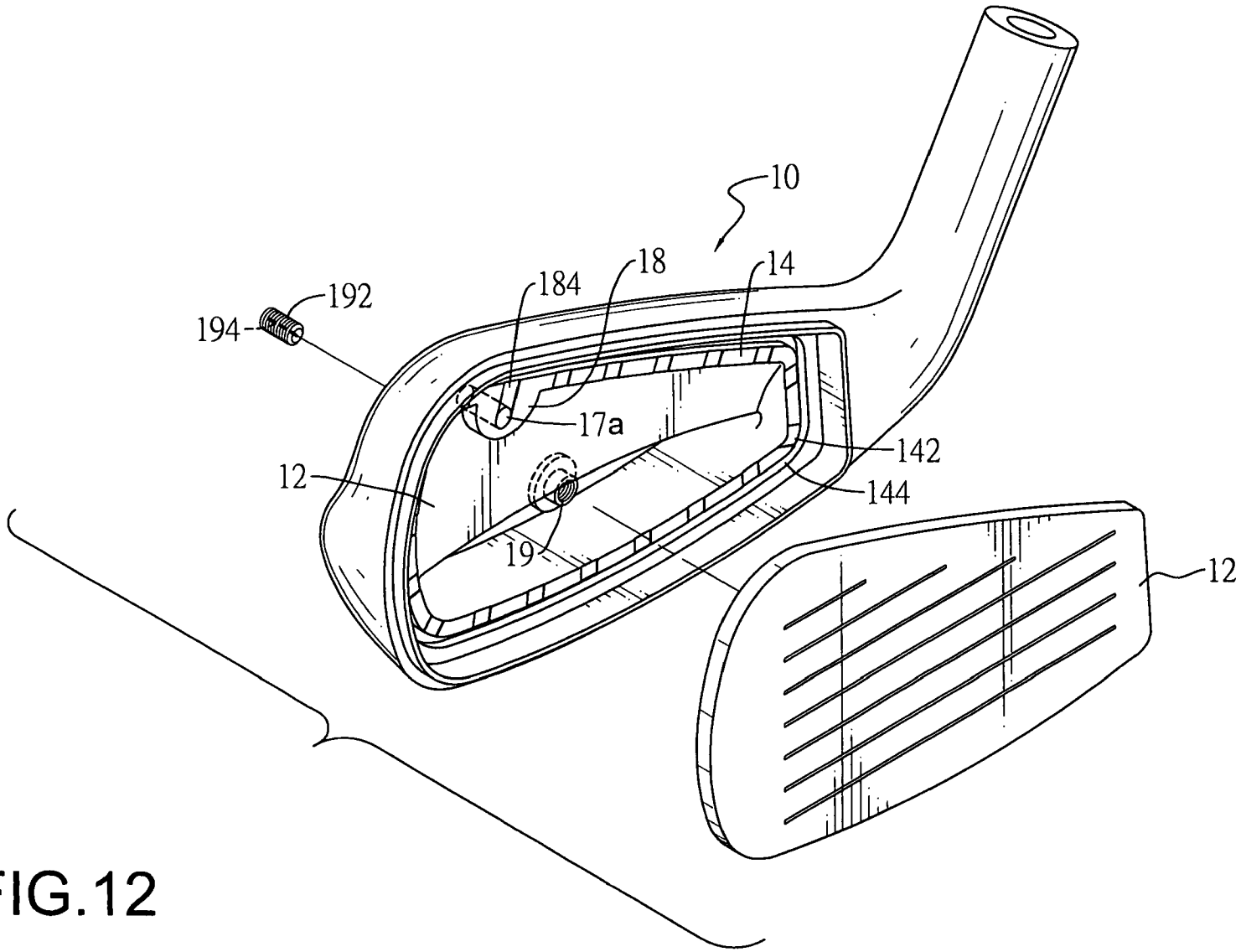
FIG. 12 is an exploded perspective view of a fourth embodiment of a shock-absorbing golf club head in accordance with the present invention.
Figure 15:
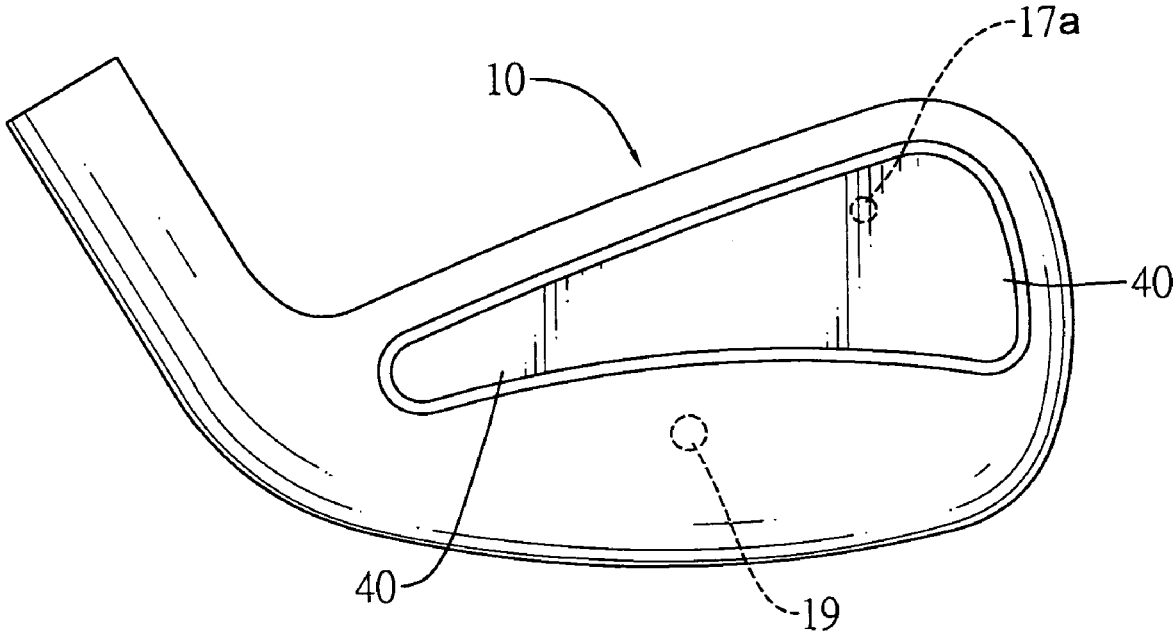
FIG. 15 is a rear view of the shock-absorbing golf club head in FIG. 12.

With reference to FIGS. 12 to 15, a fourth embodiment of the shock-absorbing golf club head in accordance with the present invention has all the features of the second embodiment and the third embodiment. The air in the core cavity (12) is discharged to the ambient atmosphere through the air outlet (17, 17*a*) when a foaming agent serving as the shock-absorbing core (30) foams inside the core cavity (12). Therefore, the shock-absorbing core (30) has a uniform density to provide an excellent shock-absorbing effect.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A shock-absorbing golf club head comprising:

a head body having a crown;

a sole;

a toe;

a shank;

a rear;

an open front having an inner shoulder;

a core cavity defined in the head body and communicating with the open front;

an inner front annular surface defined between the inner shoulder and the core cavity and having multiple notches defined radially in the inner front annular surface and communicating with the core cavity; and an annular groove defined in the inner front annular surface around the core cavity and communicating with the notches;

an air outlet defined through the rear of the head body and communicating with the annular groove; and a faceplate mounted securely on the inner shoulder of the open front of the head body; and a shock-absorbing core mounted in the core cavity.

2. The shock-absorbing golf club head as claimed in claim 1, wherein:

the head body further comprises a protrusion formed on the inner surface of the core cavity flush with the inner front annular surface and having a guide recess defined in the protrusion and communicating with the annular groove; and the air outlet extends through the protrusion and communicates with the guide recess.

3. The shock-absorbing golf club head as claimed in claim 2, wherein the head body further has a core port defined through the rear of the head body, communicating with the core cavity and having an inner thread; and a plug is mounted detachably in the core port, having an outer thread corresponding to the inner thread of the core port and screwing into the core port.

4. The shock-absorbing golf club head as claimed in claim 3, wherein the plug has a ventilation hole defined axially through the plug and communicates with the core port.

5. The shock-absorbing golf club head as claimed in claim 3, wherein:

the head body further has a rear recess defined in the rear of the head body and communicates with the air outlet; and a rear panel is mounted in the rear recess and seals the air outlet.

6. The shock-absorbing golf club head as claimed in claim 1, wherein the head body further has a core port defined through the rear of the head body, communicating with the core cavity and having an inner thread; and a plug mounted detachably in the core port, having an outer thread corresponding to the inner thread of the core port and screwing into the core port.

7. The shock-absorbing golf club head as claimed in claim 6, wherein:

the head body further has a rear recess defined in the rear of the head body and communicates with the air outlet; and a rear panel is mounted in the rear recess and seals the air outlet.

* * * * *